United States Patent [19]

Case et al.

[11] 4,284,493

[45] Aug. 18, 1981

[54] ELECTROCOATING APPARATUS

[75] Inventors: Leo L. Case, Troy; Michael A. Koltuniak, Warren, both of Mich.

[73] Assignee: Elcoat Systems, Inc., Warren, Mich.

[21] Appl. No.: 104,876

[22] Filed: Dec. 18, 1979

[51] Int. Cl.[3] ..... C25D 113/22

[52] U.S. Cl. ..... 204/299 EC; 204/300 EC; 204/301; 204/151

[58] Field of Search ..... 204/151, 180 P, 301, 204/181, 299 EC, 300 EC

[56] References Cited

U.S. PATENT DOCUMENTS 3,444,066 5/1969 Brewer et al. ..... 204/301 X 3,671,412 6/1972 Lohr ..... 204/301 X

*Primary Examiner*—Howard S. Williams

*Attorney, Agent, or Firm*—Whittemore, Hulbert & Belknap

[57] ABSTRACT

A modular membrane box for use in an electrocoating system. The modular construction allows a number of cells to be assembled as a single unit as may be required by the tank dimensions. The anolyte supply and return lines, which are pressurized, and the membrane box assemblies and their controls are removably mounted on the tank. Provisions are made for easy and relatively inexpensive installation, inspection and maintenance of the membrane boxes, piping and controls.

17 Claims, 9 Drawing Figures

18
16
36
38
20
24
22
34
26
30
32
163
28
151
14

16
187
34

12
14
192

FIG. 5
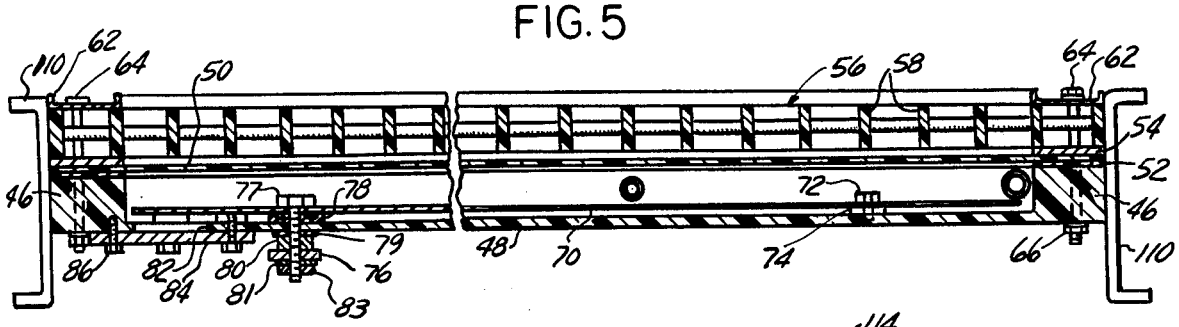
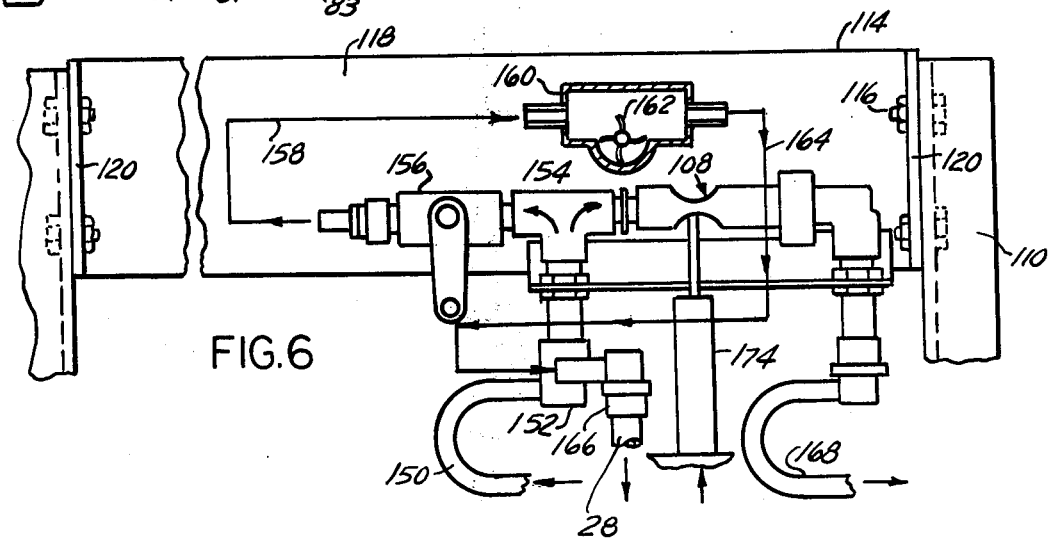
FIG. 6
FIG. 7
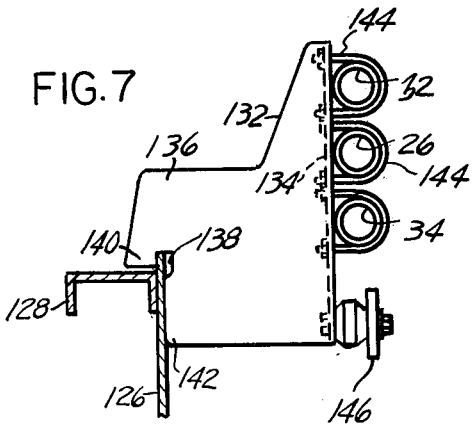
FIG. 8
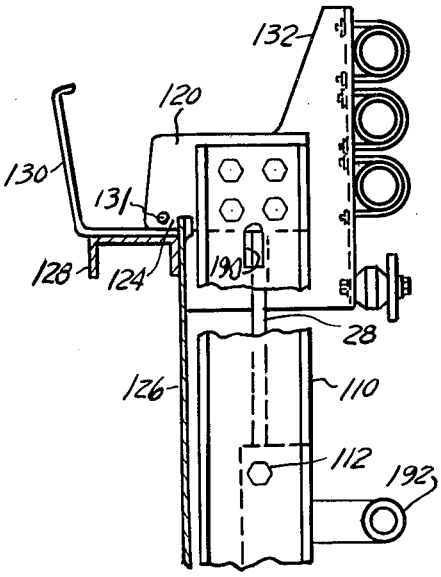

ELECTROCOATING APPARATUS

BACKGROUND OF THE INVENTION

Prior art membrane boxes generally extend well above the fluid level in the tank to accommodate a gravity return flow for the anolyte liquid, and are designed to fit or be mounted on only the tank in which they are used. In addition, the design and mounting of presently used membrane boxes requires expensive and time-consuming inspection and maintenance. The present invention is intended to eliminate the foregoing and other disadvantages of existing electrocoating systems.

SUMMARY OF THE INVENTION

Each membrane box or cell is supplied with anolyte liquid from the bottom wall thereof and the liquid is withdrawn from the top wall, enabling two or more identical cells to be connected by plastic fittings to form a unit of desired height. Each unit is mounted on the tank by a hanger assembly which carries the controls which regulate the supply and withdrawal of anolyte liquid for the unit. The anolyte piping and the electric supply for the system is carried by hanger assemblies which are removably mounted on the tank, and each unit is connected to the piping and electrical bus by detachable connections so that each unit can be readily removed from the tank for maintenance or replacement. The anolyte system is pressurized allowing the entire unit to be immersed in the tank liquid and eliminating the need for a gravity return pipe for the anolyte liquid.

DESCRIPTION OF THE DRAWINGS

In the drawings,

FIG. 5 is a sectional view taken on line 5—5 of FIG. 4;

FIG. 6 is a schematic view of the control system for a unit;

FIG. 7 is a sectional view showing the mounting of the liquid piping and electrical supply for the system; and FIG. 8 is a sectional view showing the mounting of a membrane unit on the tank.

As shown in FIGS. 1 and 2 an electrocoating system according to the present invention includes an electrocoating tank 10 through which the work 12 is moved by any suitable conveyor means in a well-known manner. The tank 10 contains the paint solution to be applied to the work as the work moves through the tank. The tank supports a series of membrane box units 14 which are mounted on each side of the tank. The membrane units 14 are described herein as being of the type suitable for use in a cathodic electrocoating system, the details of which process are known in the art and form no part of the present invention, although it is contemplated that such units may be useful in related applications.

Figure 1:
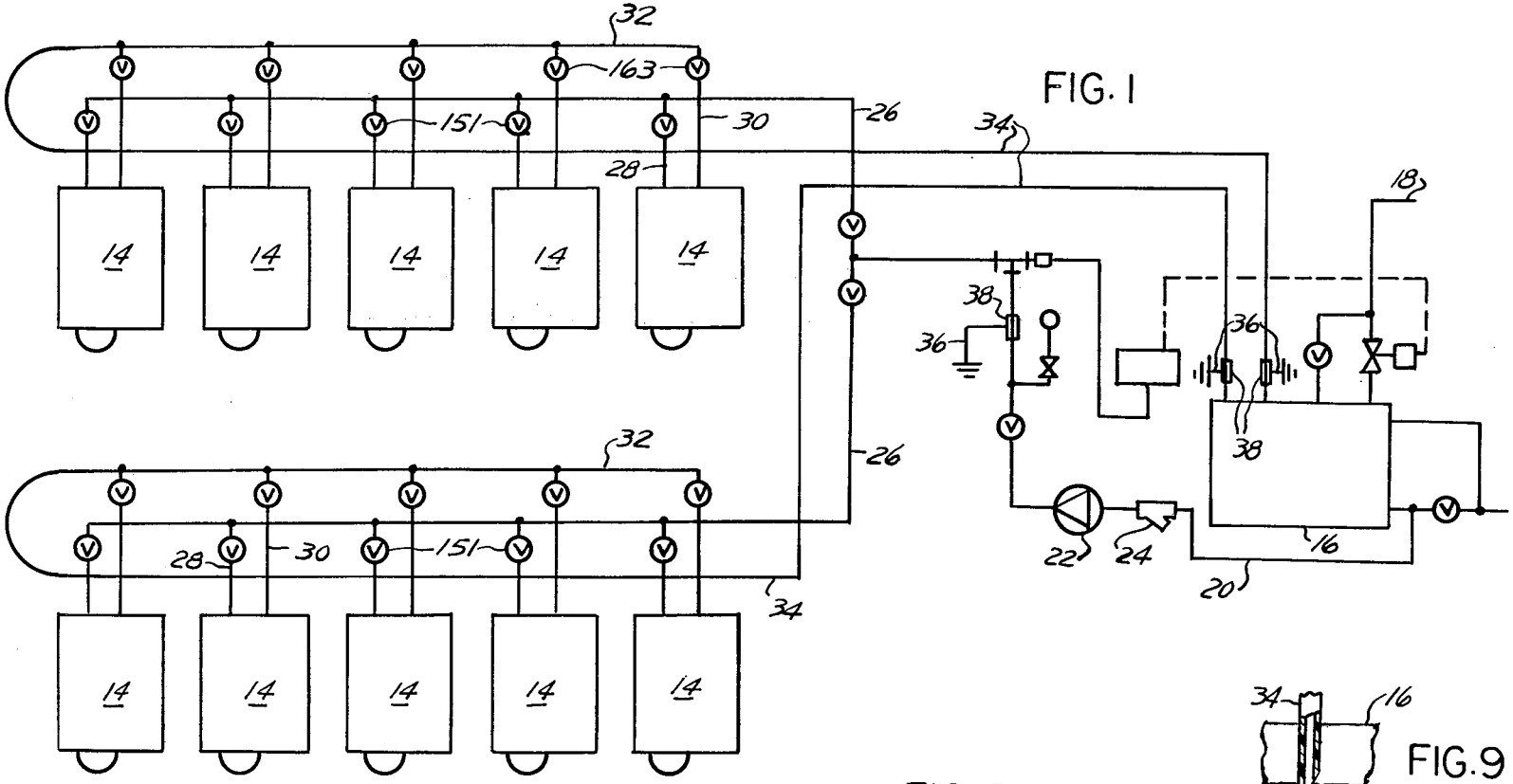
FIG. 1 is a schematic view of a cathodic electrocoating system and apparatus according to the present invention.

The membrane units 14 are supplied from an anolyte tank 16 which is supplied with deionized water from a supply line 18 under the control of suitable valving and the like in a conventional manner. The anolyte liquid is withdrawn from the tank 16 through a line 20 by a pump 22 and a filter 24 is connected into the line 20. The anolyte liquid is then supplied to branched supply lines 26 which extend along each side of the tank 10 as will be more fully described. Each of the membrane units 14 has an inlet pipe 28 connected to its supply line 26 and an outlet pipe 30 leading to a return line 32 which has a reverse return portion 34 leading back to the anolyte tank 16. The tank supply line 20 and the return lines 34 are made of a plastic material such as polyvinyl chloride and such lines are grounded as indicated schematically at 36 in FIG. 1 by placing a short length of stainless steel pipe 38 in each of such lines with the pipe 38 exposed to the liquid carried by the pipe 34 and 20.

Figure 3:
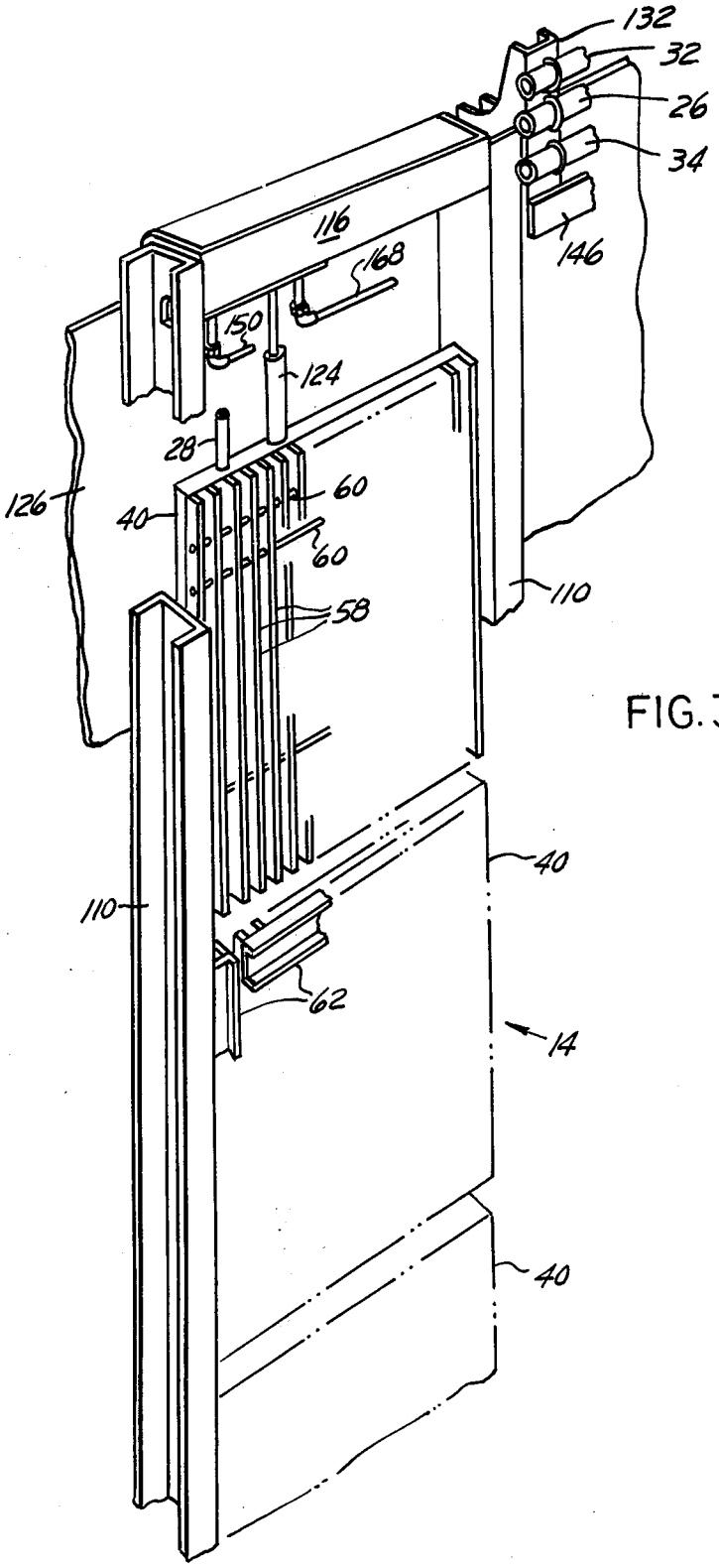
FIG. 3 is a perspective view of a membrane box unit.
Figure 4:
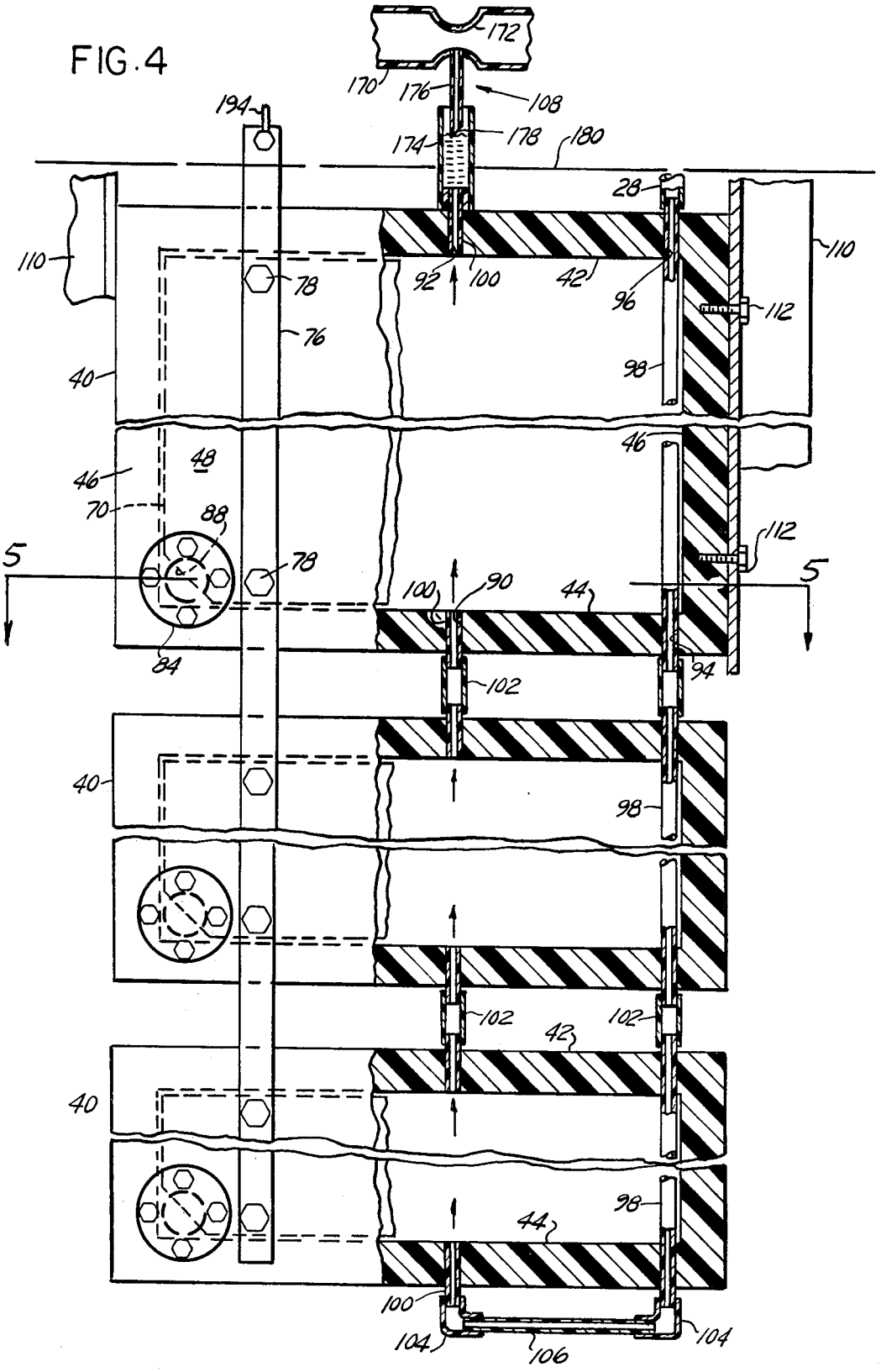
FIG. 4 is a plan view partly in section of a membrane unit.

Each of the units 14 comprises one or more membrane boxes 40, the construction of which is more particularly shown in FIGS. 4 and 5. Each membrane box 40 includes a top wall 42, a bottom wall 44, side walls 46, and a back wall 48. The boxes are preferably made of polyvinyl chloride, but may be made of any insulating material of sufficient mechanical strength and able to withstand chemical action. The front wall of the box 40 is open and is adapted to be closed by an ion-selective membrane 50 of a type well-known in the art. In some installations the membrane need not be ion-selective. The membrane 50 over lies a gasket 52 which surrounds the open front wall of the membrane box and the membrane 50 is clamped against the gasket 52 by a back-up plate 54 to seal the space within the box from the liquid in the coating tank. A grill indicated generally at 56 is placed over the front wall of the box and includes a series of vertical members 58 connected by transverse rods 60, these elements preferably being made of plastic. The grill extends for the full height and width of the membrane box 40 and as shown in FIGS. 3 and 5 generally U-shaped clamping members 62 engage the two outermost vertical strips 50 at each side of the grill and similar channel shaped members 62 extend across the top and bottom of the grill. Bolts 64 extend through the clamping member 62 and through holes in the back-up plate 54, the membrane 50, gasket 52 and the peripheral walls of the box to receive nuts 66 which rigidly clamp the entire assembly together. The bolts 64 are provided at spaced intervals around the entire periphery. With the grill construction described there can be no paint build-up on the horizontal rods 60, which eliminates a corresponding build-up on the membrane, leaving the entire surface of the electrode available for exposure in the process.

Within the membrane box 40 an electrode 70, constituting an anode in the described embodiment, and preferably made of stainless steel is secured to the back wall 48 of the box by a series of screws 72 threaded into the bosses 74 on the inner surface of the back wall 48. The plate 70 covers substantially the entire inner surface of the back wall 48 and is spaced from and parallel to the membrane 50. A stainless steel conductor bar 76 extends vertically in spaced relation to the back wall 48 of the box 40 and is clamped thereto by bolts 77 the heads of which are welded to plate 70.

A plastic retaining cup 78 carrying an O-ring is secured to the back wall 48 to seal the opening through which the bolt extends. A washer 79 and a nut 80 threaded onto the bolt completes the seal. A lockwasher 81 and a nut 83 secure the conductor bar 76 to the bolt to establish an electrical connection between bar 76 and the anode plate. The wall 48 of the membrane box at one of the lower corners thereof is provided with an opening 82 provided with a cover plate 84 which is secured to the box by screws 86. The lower corner of the anode plate 70 opposite the opening 82 is cut-off as shown at 88 in FIG. 4. When the cover plate 84 is removed for inspection purposes, the thickness of the anode plate may be determined by a micrometer to determine when it is necessary to replace the anode plate. The opening 82 also provides a means by which the box may be drained when necessary.

All of the membrane boxes 40 are of identical construction and only a single membrane box 40 or two, three and even more boxes may be stacked vertically as shown in FIGS. 3 and 4 to provide a unit of desired height according to the depth of the tank on which the unit is used. When two or more membrane boxes are stacked to form a unit 14, the conductive bar 76, of course, extends for the full depth of the stacked units and is secured to the anode plate in each unit in the manner described.

The membrane box 40 is provided with an inlet opening 90 in its bottom wall and an outlet opening 92 in its top wall. A second pair of aligned openings 94 and 96 are provided in the bottom and top walls. A length of plastic pipe 98 extends through the aligned opening 94 and 96 and is extended for a short distance above and below top and bottoms walls. Short lengths of similar pipes 100 are fitted into the inlet and outlet openings 90 and 92. The inlet pipe 28 for each unit is connected to the pipe 98 of the uppermost box of the unit and couplings 102 connect the lower end of each pipe 98 with the upper end of the pipe 98 of the next lower box. The lowermost box 40 is provided with an elbow fitting 104 secured to the lower ends of the pipes 98 and 100 and a pipe 106 connects such fittings as shown in FIG. 4. The pipes 100 of adjacent boxes 40 are connected by couplings 102 so that as shown in FIG. 4 the anolyte liquid is supplied from pipe 28 downwardly through the series of pipes 98 to the lowermost pipe 100, whereby the boxes are successively filled from the bottom thereof beginning with the lowermost box in the series. With this arrangement any air or other gases within the boxes will be forced upwardly through the series of pipes 100 until finally forced out of the uppermost box through and eductor device 108 to be more fully described hereinafter.

A channel-shaped support member 110 extends along each side of the box and is rigidly secured thereto by bolts 112. The upper ends of the channel members 110 extend above the upper box 40 and have a control box 114 secured thereto by bolts 116. The control box 114 contains the controls by which the liquid is supplied to and withdrawn from the membrane boxes of each unit 14. As shown in FIGS. 6 and 8 the control box includes a transverse wall 118 and outwardly projecting walls 120, the latter being bolted to the support channels 110. As shown in FIG. 8, the outer ends of the walls 120 are cut out as at 122 to form a hook like projection 124 which is adapted to be fitted over the top edge of the side wall 126 of the tank 10. The upper edges of the tank side walls 126 are reinforced by channels 128 and a cover plate 130 is hingedly mounted by pins 131 to the arms 120 so that the cover plate may be opened as shown in FIG. 8 to provide access to the controls within the control box 114.

Referring to FIGS. 3 and 7 the piping and the electrical bus bar needed for the membrane units 14 at each side wall of the tank are carried by support brackets 132 which have a vertical wall 134 and outwardly projecting side walls 136 with the latter being cut out as shown at 138 to form projections 140 which are fitted over the top wall of the tank. The side walls also include portions 142 which extend downwardly into the tank for a short distance and engage the inner surface of the tank to support the brackets 132 in an upright position on the sides of the tank. The supply pipe 26 and the return lines 32 and 34 are secured to the support brackets 132 by U-bolts 144. The electrical bus bar 146 is also secured to each of the brackets 132. It is to be understood that the pipes 26, 32, and 34 and the bus bar 146 extend throughout the length of the tank at each side thereof and that a plurality of support brackets 132 are provided along the length of the tank as may be required to support the piping and bus bar.

One of the control units is shown in FIG. 6 and includes a length of flexible, clear plastic piping 150 which is connected to the supply pipe 26 by a suitable detachable coupling (not shown) with a shut-off valve 151 provided between the pipe 26 and the detachable coupling. The anolyte liquid is supplied from the piping 150 into a fitting 152 and a flow divider fitting 154 where one part of the flow is to the left as viewed in FIG. 6 through a valve 156 and a line 158 to a flow indicator 160, the latter having a paddle wheel device 162 therein which is rotated as the liquid flows through the indicator 160. A glass covered port in the indicator enables the operator to determine when liquid is flowing through the control units. From the flow indicator 160 the liquid is supplied through a line 164 to a fitting 166 to which the pipe 28 is connected. The other part of the flow through the flow divider 154 is through an eductor member 108 and then to a clear plastic pipe 168 which is connected into the return pipe 32 through a detachable coupling and shut-off valve 163 similar to the connection of the pipe 150 with the supply pipe 26. As shown in FIG. 4 the eductor 108 comprises a length of pipe 170 having a venturi section 172 and a stand pipe 174 into which the pipe 100 in the upper wall of the box 40 opens. A tube 176 opens into the venturi 172 and extends downwardly into the stand pipe 174 and has a lower beveled edge 178. When the system is in normal use, liquid within the upper membrane box 40 will be drawn upwardly through pipe 100 and into the standpipe 174 to a level slightly above the liquid level in the tank 10, which is indicated at 180 in FIG. 4. Any gases which are present in any of the cells will rise and will eventually be drawn off through the pipe 100 which, being of larger diameter then the tube 176, will allow such gases to bubble up through the liquid in the standpipe and to be dispersed into the atmosphere. If the liquid level in the pipe rises, the tube 176 will draw off liquid from the stand pipe due to the venturi action within the tube 170. Referring again to FIG. 1 the pump 22 and the controls associated with the anolyte supply system are designed to supply the anolyte liquid to the supply lines 26 at a pressure of approximately 25 psi and the pressure in the return lines 32 may be of the order of 5 psi. The anolyte liquid is, therefore, continually circulated through all cells equally and then returned to the anolyte tank 16 where the pH is adjusted by the addition of the proper amount of de-ionized water. The beveled edge 178 on pipe 176 provides a variable orifice and acts as a vacuum breaker. The edge 178 allows the entry of air into the pipe 176 without excessive foaming as the liquid level in standpipe 174 falls. Since the return pipe 168 is a clear plastic the operator can visually observe the small amount of aeration of the liquid in the return line as a check on proper operation of the system.

Figure 9:
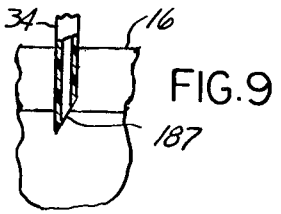
FIG. 9 is an enlarged view of a feature of the anolyte tank.
Figure 2:
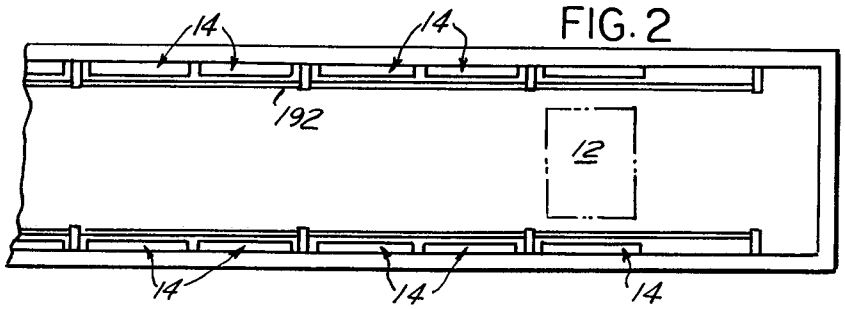
FIG. 2 is a fragmentary plan view of a tank and membrane box assemblies mounted therein.

Referring to FIG. 9, the return lines 34 are provided with a beveled lower edge 187 which provides a vacuum breaker and also eliminates excessive foaming in the tank 16.

The described construction of the membrane boxes enables the use of two or more boxes to form a cell of desired height depending upon the type of work being processed and also upon the depth of the tank so that the present system can be used with existing as well as new tanks. The manner in which each unit is mounted on the tank greatly facilitates installation of the units and removal thereof for inspection, maintenance or replacement as required. As shown in FIG. 8, the support channels 110 have openings 190 adjacent their upper ends to receive hooks carried by an overhead crane or the like so that the units are easily installed and removed from the tank. There is no permanent connection to the tank and thus, no need to penetrate or disturb the dielectric coating on the tank when installing the cell units. It should also be noted as shown in FIG. 8 that the membrane cells are removable vertically without disturbing the piping and thus carried by the brackets 132. In addition, the cells are positioned between the tank wall 126 and the guard rails 192, which are normally provided on the tank walls to insure that there can be no contact between work being processed and the membrane cells. The support brackets 132 and the pipes carried thereby do not extend inwardly from the wall of the tank to any great extent then the guard rails 192 provided on the tank. It is preferable that the support rails 110 have a width sufficient to space the membrane boxes and the conductive bar 76 and the bolt 77 from the tank wall. The conductive bar 76 is connected to the bus bar 146 by detachable cables 194, and thus when it is desired to remove any cell from the tank for inspection or maintenance it is merely necessary to disconnect the cable 194 from the bus bar and disconnect the piping 150 and 168 from the pipes 26 and 32 respectively. Since the system is pressurized it is possible to use relatively small diameter piping as compared with those used in conventional systems. The pressurized system allows the boxes to be completely immersed in the tank liquid thus utilizing the entire membrane and electrode surface, and eliminating any air-liquid interface on the membranes, which in prior constructions causes paint build-up on those portions of the membrane which are successively wet and dry as the liquid level rises and falls.

The membrane box construction described herein may also be used as a means to support bare electrodes in installations where such may be employed. In such cases, of course, the piping and associate controls need not be used with those boxes that do not require the use of a membrane in a particular area of the tank. It is contemplated that one or more boxes containing a membrane may be stacked vertically with one or more boxes carrying only a bare electrode as conditions may require. The mounting arrangement for both the membrane units and the support hangers 132 provides great flexibility in mounting the units at a desired spacing along the length of the tank.

We claim:

1. In an electrocoating apparatus, a membrane box assembly comprising a plurality of identical membrane boxes, each box having top and bottom walls, side walls and a back wall, each box having a membrane forming the front wall thereof, an electrode plate secured to the inner surface of said back wall, an inlet opening in said bottom wall and an outlet opening in said top wall, aligned openings in said top and bottom walls and a supply tube extending between said aligned openings, support members for supporting two or more of said boxes in vertically stacked relation, piping connecting the lower end of the supply tube of an upper box with the upper end of the supply tube of the next lower box of said assembly, additional piping connecting the outlet opening of a lower box with the inlet opening of the next upper box of said assembly, and piping disposed exteriorly of the lowermost box of said assembly and communicating the lower end of its supply tube with its inlet opening.

2. Apparatus according to claim 1, said support members extending above the upper box and control means for controlling the supply of liquid to said boxes, said control means being mounted on and disposed between the upper ends of said support members.

3. Apparatus according to claim 2, including means carried by the upper ends of said support members for removably mounting said assembly on the wall of a tank.

4. Apparatus according to claim 3, including an electrical conductor secured to the back wall of each of said boxes and means forming an electrical connection between said conductor and the electrode plate in each of said boxes.

5. Apparatus according to claim 4, including a stand pipe on the top wall of the uppermost box communicating with the outlet opening therein, said control means including an eductor tube having a venturi portion, and an eductor pipe opening into said venturi portion and having a lower beveled edge extending into said standpipe to withdraw liquid therefrom into said eductor tube.

6. Apparatus according to claim 5, including liquid supply and return lines and support brackets to which said supply and return lines are secured, said support brackets having provisions for removably mounting said lines on the wall of a tank, said control means having an inlet and an outlet fitting, detachable flexible piping connecting said inlet and outlet fittings with said supply and return lines respectively, said eductor tube being supplied with liquid from said inlet fitting and opening into said outlet fitting.

7. Apparatus according to claim 6, including an electrical bus bar secured to said support brackets, and means providing a detachable electrical connection between said bus bar and said conductor.

8. In an electrocoating apparatus, a membrane box having top and bottom walls, side walls and a back wall, an ionselective membrane forming the front wall of the box, an anode plate secured to the inner surface of said back wall, an inlet opening in said bottom wall and an outlet opening in said top wall, aligned openings in said top and bottom walls and a supply tube extending between said aligned openings, piping disposed exteriorly of said box for communicating the lower end of said supply tube with said inlet opening, means for supplying liquid under pressure to the upper end of said supply tube, and eductor means for withdrawing liquid from said outlet opening.

9. A membrane box according to claim 8, including an inspection opening in said back wall at a lower corner thereof and a removable cover plate for said opening, said anode plate having an edge thereof opposite said opening whereby both said membrane and said anode plate may be inspected through said opening.

10. Apparatus according to claim 8, wherein said eductor means comprises an eductor tube having a venturi portion and supplied with liquid under pressure at one end thereof, a standpipe on said top wall communicating with said outlet opening, and an eductor pipe opening at its upper end into said venturi portion and having its lower end extending into said standpipe to withdraw liquid therefrom into said eductor tube.

11. Apparatus according to claim 8, including a protective grill secured to the front wall of said box and overlying said membrane, said grill having a plurality of spaced vertical and horizontal members, said horizontal members being spaced outwardly from the inner portions of said vertical members whereby only said vertical members are contacted by said membrane.

12. In a cathodic electrocoating apparatus, including an electrocoating tank, a membrane box assembly comprising a plurality of identical membrane boxes, each box having top and bottom walls, side walls and a back wall, each box having an ionselective membrane forming the front wall thereof, an anode plate secured to the inner surface of said back wall, an inlet opening in said bottom wall and an outlet opening in said top wall, aligned openings in said top and bottom walls and a supply tube extending between said aligned openings, support members for supporting two or more of said boxes in vertically stacked relation, piping connecting the lower end of the supply tube of an upper box with the upper end of the supply tube of the next lower box of said assembly, additional piping connecting the outlet opening of a lower box with the inlet opening of the next upper box of said assembly, piping disposed exteriorly of the lowermost box of said assembly and communicating the lower end of its supply tube with its inlet opening whereby said boxes may be filled with anolyte liquid successively beginning with the lowermost box, means for supplying liquid under pressure to said upper end of the supply tube of the uppermost box, eductor means for withdrawing liquid from the outlet opening of the uppermost box, and means secured to said support members for removably supporting said assembly on the wall of said tank.

13. Apparatus according to claim 12, including liquid supply and return lines for said assembly and means for supporting said supply and return lines on said tank, control means mounted on said assembly, said control means including an inlet fitting and an outlet fitting, detachable piping connecting said inlet and outlet fittings with said supply and return lines respectively, said eductor means being supplied with liquid from said inlet fitting and opening into said outlet fitting.

14. Apparatus according to claim 13, including support brackets for mounting said supply and return lines on said tank, an electrical bus bar carried by said brackets, a conductor bar secured to the back wall of each box and electrically connected to the anode plate therein, and means providing a detachable electrical connection between said bus bar and said conductor bar.

15. Apparatus according to claim 12, wherein, each said box has an inspection and drain opening in the back wall thereof and a removable cover plate for said opening, said anode plate having an edge thereof accessible through said opening whereby said membrane and anode plate may be inspected without disassembly of the box.

16. Apparatus according to claim 12, wherein each said box is provided with a protective grill overlying the membrane therein, said grill including vertical and horizontal members so arranged that only said vertical members are engaged by said membrane.

17. Apparatus according to claim 12, including control means for regulating the supply of liquid to said assembly, said control means being mounted on said support members at the upper end of said assembly.

* * * * *